US009758917B2

(12) United States Patent
Kim et al.

(10) Patent No.: US 9,758,917 B2
(45) Date of Patent: Sep. 12, 2017

(54) FABRIC TREATMENT AGENT AND FABRIC TREATMENT APPARATUS AND FABRIC TREATMENT METHOD USING THE SAME

(71) Applicant: LG ELECTRONICS INC., Seoul (KR)

(72) Inventors: Minji Kim, Seoul (KR); Jeongyun Kim, Seoul (KR); Sungmin Ye, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 14/569,496

(22) Filed: Dec. 12, 2014

(65) Prior Publication Data

US 2015/0166934 A1 Jun. 18, 2015

(30) Foreign Application Priority Data

Dec. 12, 2013 (KR) ..... 10-2013-0154954

(51) Int. Cl.

| | |
|---|---|
| ***D06F 39/02*** | (2006.01) |
| ***D06F 35/00*** | (2006.01) |
| ***C11D 1/62*** | (2006.01) |
| ***C11D 3/00*** | (2006.01) |
| ***C11D 3/37*** | (2006.01) |

(52) U.S. Cl.

CPC ..... *D06F 39/022* (2013.01); *C11D 1/62* (2013.01); *C11D 3/0015* (2013.01); *C11D 3/373* (2013.01); *D06F 35/005* (2013.01); *D06F 39/02* (2013.01)

(58) Field of Classification Search

CPC ..... C11D 3/001; C11D 3/373
USPC ..... 510/515, 516
See application file for complete search history.

(56) References Cited

U.S. PATENT DOCUMENTS

| | | | | |
|---|---|---|---|---|
| 6,908,962 | B1 * | 6/2005 | Frankenbach | C08J 3/03 516/53 |
| 2002/0162177 | A1 | 11/2002 | Raney et al. | |
| 2009/0206296 | A1 * | 8/2009 | Dave | D3/15 |
| 2010/0132214 | A1 * | 6/2010 | DuVal | C11D 3/50 34/389 |
| 2015/0337240 | A1 * | 11/2015 | Leon Navarro | C11D 3/3742 510/515 |
| 2016/0017261 | A1 * | 1/2016 | Bautista Cid | C11D 3/3742 8/137 |

FOREIGN PATENT DOCUMENTS

| | | | |
|---|---|---|---|
| CN | 1089988 | A | 7/1994 |
| CN | 1160788 | A | 10/1997 |
| CN | 1312410 | A | 9/2001 |
| CN | 1813047 | A | 8/2006 |
| CN | 101735899 | A | 6/2010 |
| EP | 1204793 | B1 | 4/2007 |
| WO | 9816623 | A1 | 4/1998 |

* cited by examiner

*Primary Examiner* — Gregory Webb
(74) *Attorney, Agent, or Firm* — Dentons US LLP

(57) ABSTRACT

A fabric treatment agent and a fabric treatment apparatus, and a fabric treatment method using the same, wherein the fabric treatment agent is a liquid fabric treatment agent including a cationic surfactant having a content ratio of 0.5% to 1.0% and silicone oil having a content ratio of 0.05% to 0.1%.

3 Claims, 5 Drawing Sheets

FABRIC TREATMENT AGENT AND FABRIC TREATMENT APPARATUS AND FABRIC TREATMENT METHOD USING THE SAME

CROSS-REFERENCE TO RELATED APPLICATION

This application claims priority under 35 U.S.C. §119 to Korean Application No. 10-2013-0154954, filed Dec. 12, 2013, the subject matter of which is hereby incorporated by reference.

BACKGROUND

1. Field

The present disclosure relates to a fabric treatment agent, a fabric treatment apparatus, and a fabric treatment method using the same.

2. Background

A fabric treatment apparatus, which is an apparatus for treating fabric, may be classified as a washer for removing contaminants from fabric using water and detergent, a dryer for applying hot air or cold air to wet fabric to dry the fabric, or a refresher for spraying water to fabric in the form of steam or mist to unwrinkle or deodorize the fabric and thus to manage the fabric in a more comfortable state. In recent years, complex apparatuses, such as a combination dryer and washer, and a washer or a dryer having a refreshing function, capable of complexly performing functions of the above-mentioned apparatuses have also been widely used.

When some kinds of fabric (e.g., wool or silk) are wet, however, the fabric severely shrinks damaging the fabric.

In recent years, a treatment agent specially devised to prevent damage to sensitive fabric has been used. However, this treatment agent is provided as a powder or sheet type treatment agent. As a result, it is difficult to uniformly apply ingredients of the treatment agent to fabric. In particular, for the sheet type treatment agent, it is necessary for a user to remove the sheet after fabric treatment is completed, which is very troublesome. Additionally, a hand of the user may be stained by ingredients of the treatment agent remaining on the sheet.

SUMMARY

One object is to provide a liquid fabric treatment agent suitable for treating sensitive fabric.

Another object is to provide a fabric treatment apparatus that sprays a liquid fabric treatment agent.

Yet another object is to provide a fabric treatment method using a liquid fabric treatment agent.

A fabric treatment agent according to one embodiment of the present invention has the effect of restraining generation of bubbles while sufficiently removing soil from fabric due to a cationic surfactant and silicon oil having proper contents and, in particular, preventing the cationic surfactant from being deposited in a treatment space. Additionally, the fabric treatment agent can be sprayed in a liquid state and can be utilized to remove local contaminants from the fabric. The fabric treatment agent may be used to treat fabric in a dryer or a refresher in addition to a washer.

A fabric treatment apparatus according to one embodiment of the present invention has the effect of spraying a liquid fabric treatment agent to fabric simply and easily removing contaminants from the fabric and reducing water and power consumption.

A fabric treatment method according to one embodiment of the present invention has the effect of restraining shrinkage or denaturalization of fabric sensitive to water.

BRIEF DESCRIPTION OF THE DRAWINGS

Embodiments will be described in detail with reference to the following drawings in which like reference numerals refer to like elements, and wherein.

DETAILED DESCRIPTION

Advantages and features of the invention, and methods for achieving the same may become apparent upon referring to the embodiments described later in detail together with attached drawings. However, embodiments are not strictly limited as disclosed hereinafter, but may be embodied in different modes. The same reference numbers may refer to the same elements throughout the specification.

Hereinafter, a dryer, which is a kind of fabric treatment apparatus, will be described by way of example; however, the present invention is not limited thereto. For example, the present invention may be applied to other kinds of fabric treatment apparatuses, such as a washer, a refresher, and a washer/dryer combo, without departing from the concept of the invention.

Figure 1:
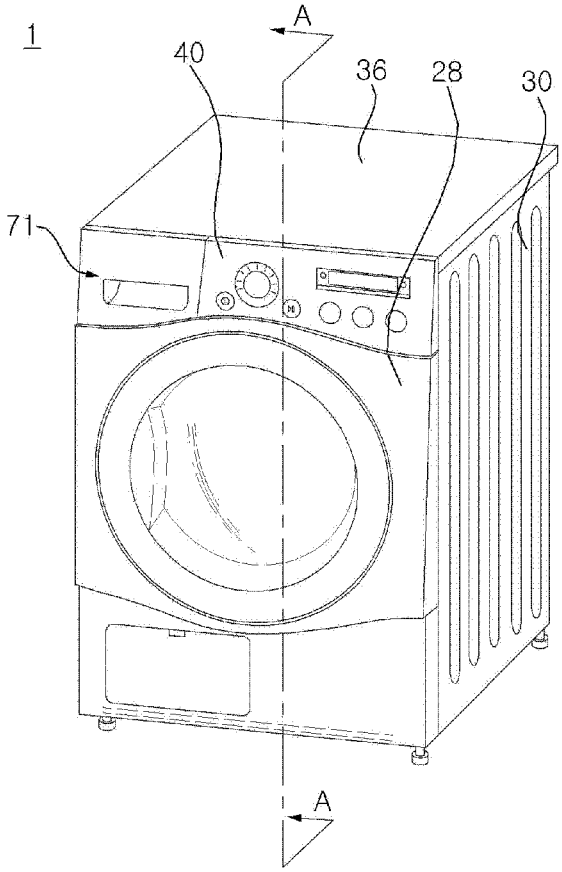
FIG. 1 is a perspective view showing a dryer according to an embodiment of the present invention.
Figure 2:
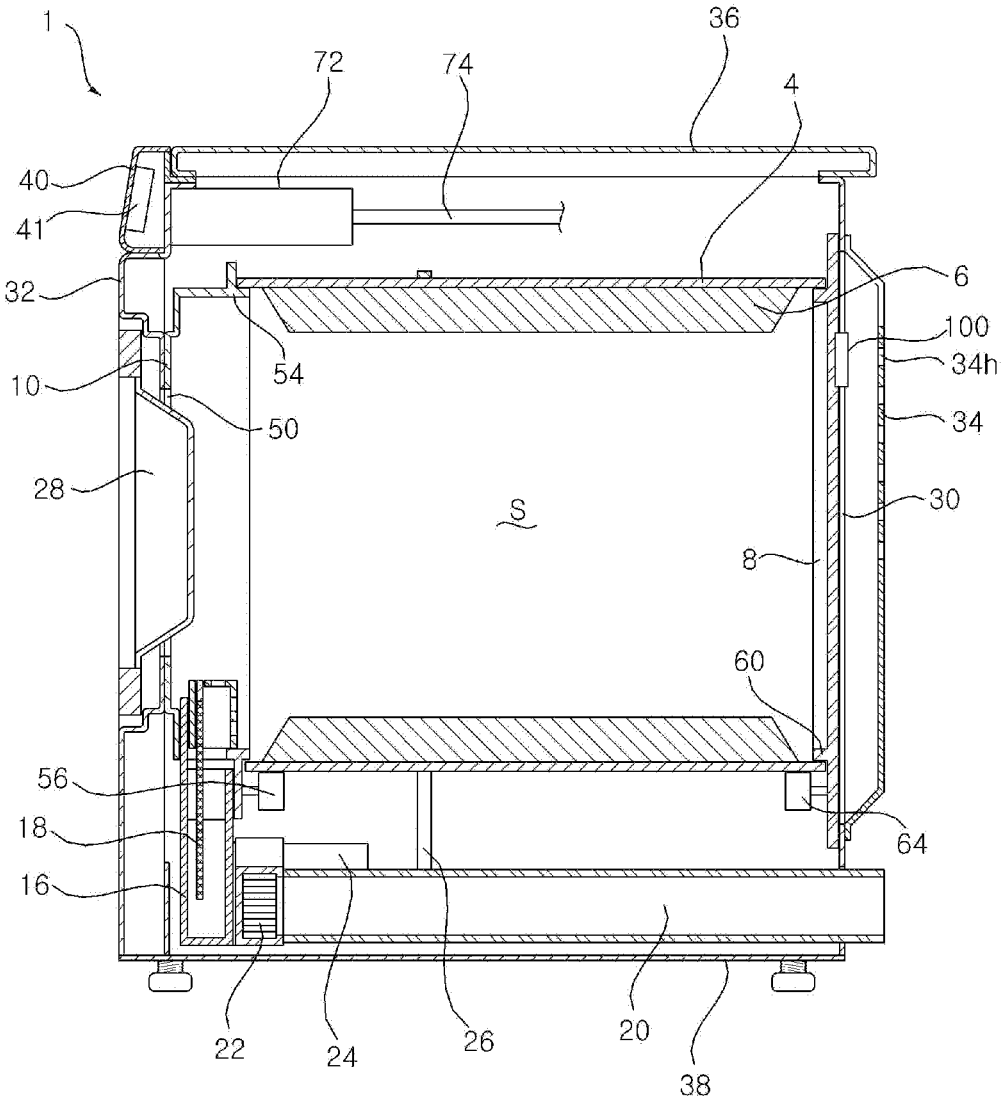
FIG. 2 is a sectional view taken along line A-A of FIG. 1.
Figure 3:
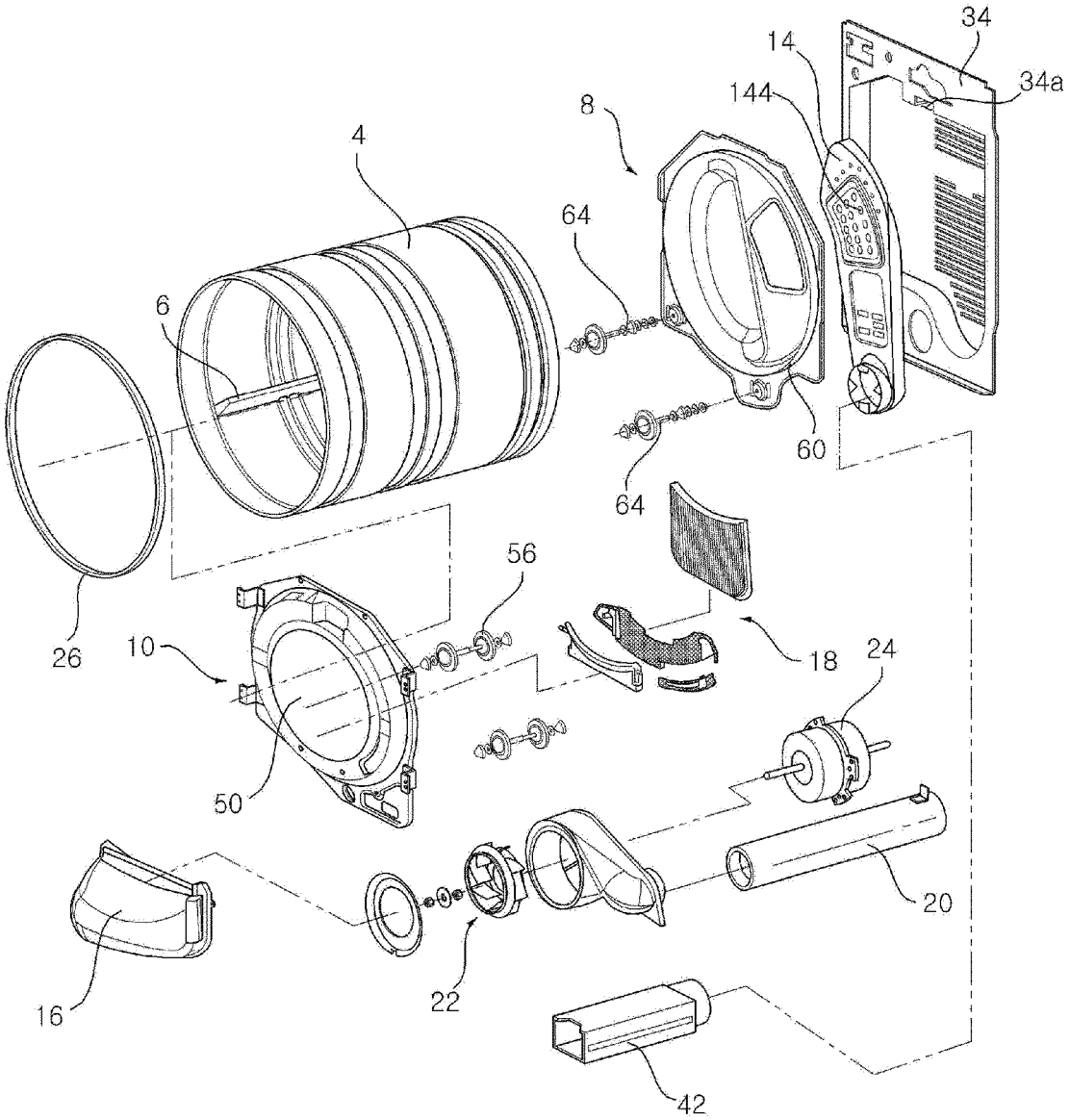
FIG. 3 is an exploded perspective view showing the dryer according to the embodiment of the present invention.
Figure 4:
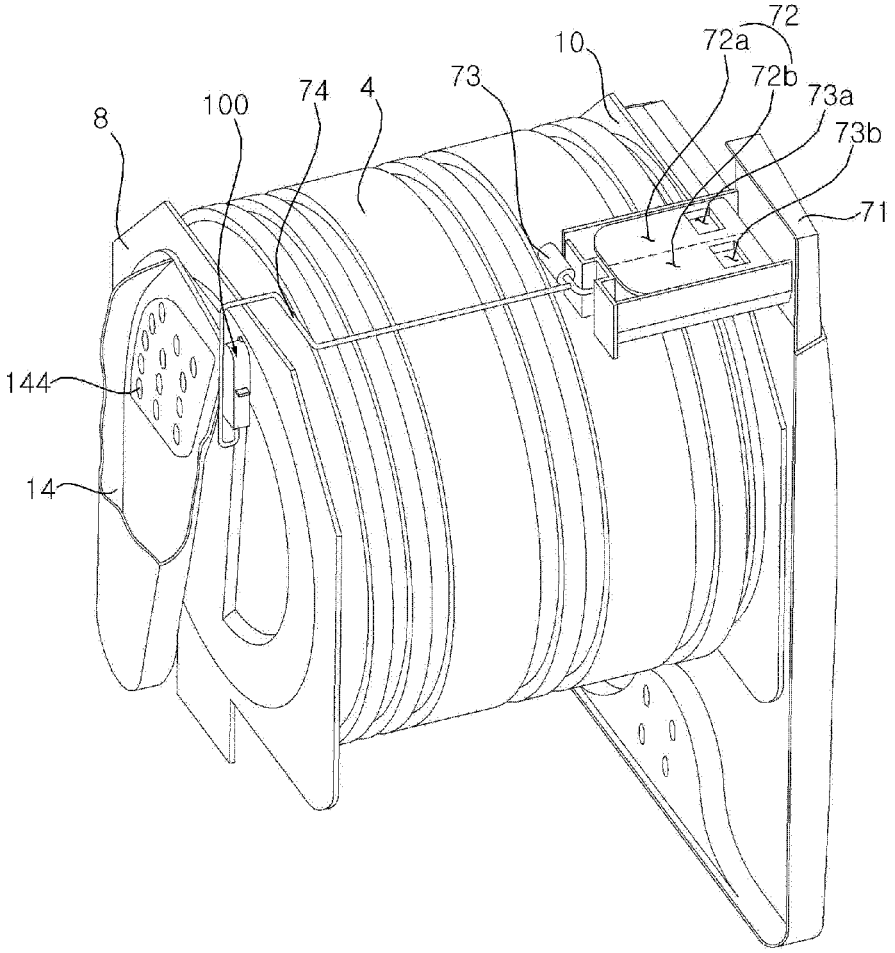
FIG. 4 is a perspective view showing the interior of the dryer including a spray device.

FIG. 1 is a perspective view showing a dryer according to an embodiment of the present invention. FIG. 2 is a sectional view taken along line A-A of FIG. 1. FIG. 3 is an exploded perspective view showing the dryer according to the embodiment of the present invention. FIG. 4 is a perspective view showing the interior of the dryer including a spray device.

Referring to FIGS. 1 to 4, a dryer 1 according to an embodiment of the present invention includes a treatment space forming unit having a treatment space S, in which fabric is treated, formed therein. The treatment space forming unit may include a drum 4 rotatably disposed therein. Hereinafter, the treatment space forming unit will be described as drum 4 by way of example; however, the present invention is not limited thereto. According to rotation of drum 4, the position of fabric may be changed. In particular, the fabric may be lifted and then dropped by lifters 6 disposed at the inner circumference of the drum 4.

A casing, which forms the external appearance of dryer 1, may include a cabinet 30, a cabinet cover 32 mounted at the front of cabinet 30, the cabinet cover 32 including a laundry introduction port at the middle thereof, a control panel 40 provided at the upper side of cabinet cover 32, a back panel 34 mounted at the rear of cabinet 30, the back panel 34 having at least one through-hole **34*h* through which air flows into and out of cabinet 30, a top plate 36 for covering the upper part of cabinet 30, and a base 38 mounted at the lower part of cabinet 30. A door 28 for opening and closing the laundry introduction port may be hingedly connected to cabinet cover 32**.

Control panel 40 may be provided at the front of dryer 1 and includes an input unit, such as a button and/or dial, for allowing a user to input various control commands related to operation of dryer 1 and a display unit, such as a liquid crystal display (LCD) and/or a light emitting diode (LED), for visually displaying operation status of dryer 1. Control panel 40 may be provided at the rear of dryer 1 and further includes a controller 41 for controlling overall operation of dryer 1. The controller 41 can be hardware based (e.g., microprocessor) or software based.

Dryer 1 may be provided with a container 72 for supplying water to a spray device 100 such that container 72 can be withdrawn from dryer 1. A drawer 71 may be supported by cabinet 30 such that drawer 71 can be withdrawn from dryer 1 and container 72 may be received in drawer 71. Container 72 may include a treatment agent receiving unit 72*a* for receiving a fabric treatment agent.

A liquid fabric treatment agent or a diluted solution of the fabric treatment agent may be received in treatment agent receiving unit 72*a*. According to at least one embodiment, dryer 1 may further include a detergent receiving unit 72*b* for receiving a liquid detergent or a diluted solution of the detergent. Detergent receiving unit 72*b* may be provided separately from treatment agent receiving unit 72*a*. Referring to FIG. 4, the interior of container 72 is partitioned to form the treatment agent receiving unit 72*a* and the detergent receiving unit 72*b*, which are separated from each other to prevent mixing of fabric treatment agent received in the treatment agent receiving unit 72*a* and detergent received in the detergent receiving unit 72*b*. A treatment agent introduction port 73*a* and a detergent introduction port 73*b* are formed at an integrated cover.

The fabric treatment agent may be introduced into treatment agent receiving unit 72*a* together with water and the detergent may also be introduced into detergent receiving unit 72*b* together with water; however, the present invention is not limited thereto. For example, dryer 1 may further include a water supply unit for supplying water to spray device 100.

A front supporter 10 and a rear supporter 8 are provided at the front part and the rear part of the casing, respectively. The front and the rear of drum 4 are supported by front supporter 10 and rear supporter 8, respectively.

Front supporter 10 includes an opening 50 provided at the middle of front supporter 10 and in communication with the laundry introduction part. Front supporter 10 is further provided at the rear thereof with a ring-shaped front support protrusion 54 for supporting a front end of drum 4. In addition, front supporter 10 is provided at the lower part thereof with a front guide roller 56 which is rotatable. The inner circumference of the front end of drum 4 is supported by front support protrusion 54 and the outer circumference of the front end of drum 4 is supported by front guide roller 56.

Rear supporter 8 is provided at the front thereof with a ring-shaped rear support protrusion 60 for supporting a rear end of drum 4 and rear supporter 8 is provided at the lower part of the front thereof with a rear guide roller 64 which is rotatable. The inner circumference of the rear end of drum 4 is supported by rear support protrusion 60 and the outer circumference of the rear end of drum 4 is supported by rear guide roller 64.

Drum 4 is provided at a lower side thereof with a drying heater 42 for heating air. A drying duct 14 is provided between rear supporter 8 and drying heater 42 such that rear supporter 8 and drying heater 42 communicate with each other via drying duct 14 for supplying the air heated by drying heater 42 into drum 4. Front supporter 10 is provided with a lint duct 16 such that lint duct 16 communicates with front supporter 10 allowing the air having passed through drum 4 to be introduced thereinto.

Drying duct 14 is provided with a plurality of through holes 144, through which air is discharged into drum 4. Air flows in drum 4 via lint duct 16, a blower 22, and an exhaust duct 20 due to the blowing force generated by blower 22. Particularly, in the flowing process of the air, the air heated by drying heater 42 flows along drying duct 14 and is then discharged into drum 4 through the through holes 144.

Additionally the air introduced into lint duct 16 is purified by a filter 18. The casing is provided at the rear thereof with an exhaust duct 20 for guiding the air from lint duct 16 to the outside of the casing.

Blower 22 is connected between exhaust duct 20 and lint duct 16. Dryer 1 further includes a motor 24 for generating the driving force of blower 22. A transmission belt 26 interlocked with the motor 24 rotates the drum 4.

Hereinafter, ingredients of the fabric treatment agent will be described with reference to the following table. In the following description, a content ratio (or a weight ratio) will be defined as a ratio of weight of each ingredient to the entirety of the fabric treatment agent

TABLE 1

| Ingredient | I | II | III |
|---|---|---|---|
| Cationic surfactant | 1.0~1.5% | 0.5~0.7% | 0.5~1.0% |
| Silicone oil | 0.05% | 0.05% | 0.05~0.1% |
| Alcohol | 1.0% or less | 0.5% or less | X |
| Glycol ether | 1.0% or less | 0.5% or less | X |
| Silicone emulsion | X | X | 0.01~0.05% |
| Neutralizer | X | X | 0.3~0.5% |
| Emulsifier | X | X | 0.5~0.7% |
| Water | balance | balance | balance |

A cationic surfactant has advantages in that the cationic surfactant has an affinity for all kinds of fabric, has very low toxicity, is very effective even in a case in which a very small amount of the cationic surfactant is used. It is also tasteless and odorless. Additionally, the cationic surfactant is superior to other surfactants in terms of smoothness and softness. When the cationic surfactant is excessively used, however, the cationic surfactant may be deposited on the fabric with the result that dyed goods may be discolored (more specifically, yellowed) and a hydrophilic property of the fabric is lowered, which prevents removal of soil. Consequently, it is important to properly adjust a content ratio of the cationic surfactant. According to experiments, the content ratio of the cationic surfactant is 0.5 to 1.0% (compound III). For compound I of Table 1, the content of the cationic surfactant is increased to improve flexibility. However, the concentration of the cationic surfactant is high with the result that the fabric is sticky and shrinks.

The cationic surfactant may be a quaternary ammonium compound. The quaternary ammonium compound has advantages in that the quaternary ammonium compound has low corrosiveness, mild smell, and high stability to heat, pH, and organic matters. Representative example of the quaternary ammonium compound may include alkyl trimethyl ammonium sodium, dialkyl dimethyl ammonium sodium, and alkyl dimethyl benzyl ammonium sodium; however, the present invention is not limited thereto.

Silicone oil has advantages in that the silicone oil has high heat resistance and acid resistance, has low viscosity and coefficient of temperature, has high hydrophobicity, is tasteless and odorless, is physiologically inactive, and has a high antifoaming performance. The content ratio of the silicone oil is 0.05 to 0.1% (compound III). For both compounds I and II, wrinkle removal performance is lower than that of compound III due to insufficient content of the silicone oil and antifoaming is not satisfactorily performed.

In addition, for compounds I and II, alcohol and glycol ether are added as a solvent so as to prevent the occurrence of a phenomenon in which the treatment space forming unit is stained. Furthermore, melting points of the alcohol and the glycol ether are low with the result that a fire may be caused during generation of steam. For this reason, water is the base and a very small amount of silicone emulsion is added as in a case of compound III. The content ratio of the silicone emulsion may be 0.01 to 0.05%. In particular, the silicone emulsion may be water-soluble. The water-soluble silicone emulsion has high heat resistance with the result that the water-soluble silicone emulsion has a low possibility of catching fire and no toxicity. Consequently, the water-soluble silicone emulsion is harmless to humans.

Additionally, the fabric treatment agent may include a neutralizer having a content ratio of 0.3 to 0.5% and/or an emulsifier having a content ratio of 0.5 to 0.7%. In this case, it is possible to deodorize the fabric and to improve softness of the fabric.

Spray device 100 is a device for spraying the fabric treatment agent into drum 4. Spray device 100 sprays the liquid fabric treatment agent introduced from treatment agent receiving unit 72*a* together with the water into drum 4 in the form of steam or mist. Spray device 100 may further include a steam generation heater (not shown) for applying heat to generate the steam. The steam generation heater may be disposed in a predetermined flow channel of spray device 100 for guiding the liquid fabric treatment agent to a nozzle having a spray port. Since water pressure due to movement of the liquid is also applied together with the steam, the liquid fabric treatment agent is in a high temperature and high pressure state and high pressure is applied from an upper stream to a lower stream of a water stream. Consequently, steam finally sprayed through the nozzle continuously has high pressure and, therefore, the steam can reach the fabric in drum 4. Additionally, spray device 100 generates and sprays steam within a short period of time. Consequently, it is possible to reduce time necessary to spray the steam, thereby reducing power consumption, and to spray high-temperature, high-pressure steam.

When the steam generation heat is not operated, on the other hand, spray device 100 may spray the fabric treatment agent in the form of a mist, which is needed for treating thermally sensitive fabric.

During spray of the steam through the nozzle, the temperature of the steam in the spray port may be about 70° C. In a conventional method of spraying only steam, the temperature of the steam reaching the fabric is too high with the result that the fabric may be directly damaged and the fabric may be secondarily contaminated due to denaturalization of stains. In this embodiment, on the other hand, the fabric is not damaged although the spray pressure is maintained at or above a predetermined level.

Figure 5:
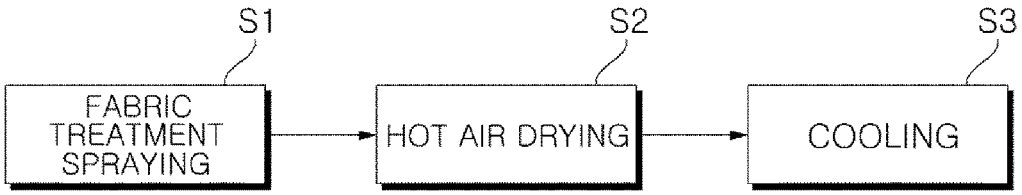
FIG. 5 is a flowchart showing a fabric treatment method according to an embodiment of the present invention.
Figure 6:
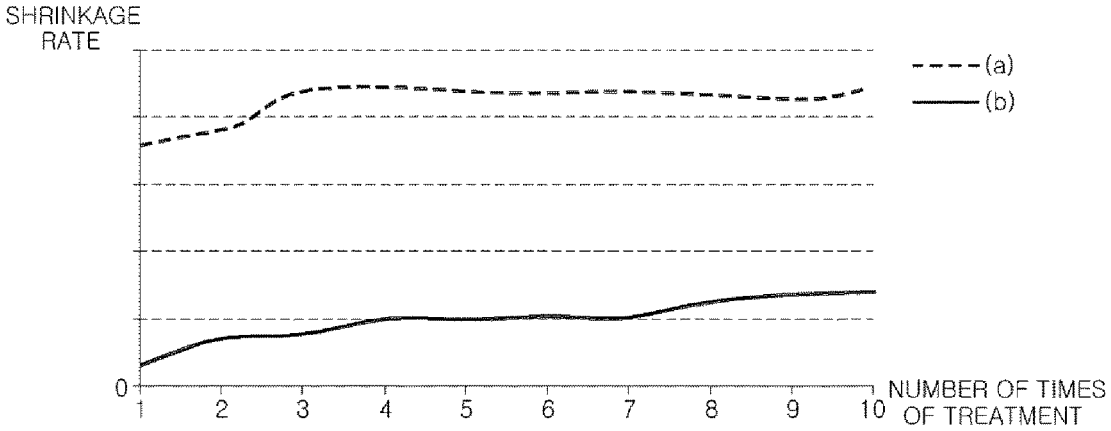
FIG. 6 is a graph showing a shrinkage rate based on the number of treatment times through a comparison between a case (a) of general washing/drying and a case (b) in which fabric is treated using the fabric treatment method according to an embodiment of the present invention.

FIG. 5 is a flowchart showing a fabric treatment method according to an embodiment of the present invention. FIG. 6 is a graph showing a shrinkage rate based on the number of times of treatment through a comparison between a case (a) of general washing/drying and a case (b) in which fabric is treated using the fabric treatment method according to the embodiment of the present invention.

Referring to FIG. 5, a fabric treatment method according to an embodiment of the present invention may include a fabric treatment spraying step (S1) comprising spraying the fabric treatment agent into the treatment space, i.e., into drum 4, for a first time period, a hot air drying step (S2) comprising supplying hot air into drum 4 for a second time period, and a cooling step (S3) comprising supplying cold air into drum 4 for a third time period.

The first time period is a time during which the fabric in drum 4 is sufficiently wetted by the fabric treatment agent. For example, the first time period may be about 1 to 3 minutes. At this time, the amount of the fabric treatment agent sprayed from the steam generation device 100 (i.e., the amount of the liquid supplied from the treatment agent receiving unit 72*a* to the steam generation device 100 and sprayed from the steam generation device 100) may be 100 to 200 cc.

Additionally, the fabric treatment spraying step (S1) may include a step of changing the position of the fabric during spraying of the fabric treatment agent. During spraying of the fabric treatment agent, drum 4 may be rotated. At this time, drum 4 may be rotated at a speed at which the fabric can be lifted to a predetermined height and then dropped, i.e. tumbled.

At the hot air drying step (S2), drying heater 42 is operated and blower 22 is rotated. Drum 4 may also be rotated in a state in which drum 4 is interlocked with blower 22. The fabric treatment agent's activeness is increased by heat applied to the fabric. The fabric is gradually dried over time. The second time period may be 10 to 15 minutes.

The cooling step (S3) is a step for cooling the high-temperature fabric. During the cooling step (S3), operation of the drying heater 42 is stopped and only blower 22 is rotated to blow air. Drum 4 may also be rotated in a state in which drum 4 is interlocked with blower 22. As the treated fabric is cooled before removal of the fabric from drum 4, it is possible to diminish the risk of accident due to high-temperature hot air. The third time period, which is a time during which the temperature in the treatment space is sufficiently lowered so as not to injure the user, may be about 1 minute.

As shown in FIG. 6, it can be seen that a shrinkage rate in the fabric treatment method (b) using the fabric treatment agent is considerably lower than that in the general washing/drying method (a) although the number of times of treatment is increased. In particular, the fabric treatment method (b) using the fabric treatment agent has an effect in that it is possible to restrain denaturalization of fabric, such as wool or silk, which is sensitive to water.

Although embodiments have been described herein with reference to a number of illustrative embodiments thereof, it should be understood that numerous other modifications and embodiments can be envisioned by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A liquid fabric treatment agent comprising:

a cationic surfactant having a content ratio of 0.5% to 1.0%;

silicone oil having a content ratio of 0.05% to 0.1%;

silicone emulsion having a content ratio of 0.01% to 0.05%;

a neutralizer having a content ratio of 0.3% to 0.5%; and an emulsifier having a content ratio of 0.5% to 0.7%.

2. The fabric treatment agent of claim 1, wherein the cationic surfactant comprises a quaternary ammonium compound.

3. The fabric treatment agent of claim 1, wherein the silicone emulsion is water-soluble.

* * * * *